US012467637B2

(12) United States Patent
Tang

(10) Patent No.: US 12,467,637 B2
(45) Date of Patent: Nov. 11, 2025

(54) CEILING MACHINE

(71) Applicants: GD MIDEA AIR-CONDITIONING EQUIPMENT CO., LTD., Guangdong (CN); MIDEA GROUP CO., LTD., Guangdong (CN)

(72) Inventor: Qingsheng Tang, Guangdong (CN)

(73) Assignees: GD MIDEA AIR-CONDITIONING EQUIPMENT CO., LTD., Guangdong (CN); MIDEA GROUP CO., LTD., Guangdong (CN)

( * ) Notice: Subject to any disclaimer, the term of this patent is extended or adjusted under 35 U.S.C. 154(b) by 1016 days.

(21) Appl. No.: 17/152,058

(22) Filed: Jan. 19, 2021

(65) Prior Publication Data

US 2021/0140651 A1 May 13, 2021

Related U.S. Application Data

(63) Continuation of application No. PCT/CN2018/112045, filed on Oct. 26, 2018.

(30) Foreign Application Priority Data

Jul. 16, 2018 (CN) ..... 201810777360.0
Jul. 16, 2018 (CN) ..... 201821126537.2

(51) Int. Cl.
*F24F 1/0047* (2019.01)
*F24F 1/0063* (2019.01)
*F24F 13/22* (2006.01)

(52) U.S. Cl.
CPC ..... *F24F 1/0047* (2019.02); *F24F 1/0063* (2019.02); *F24F 13/222* (2013.01)

(58) Field of Classification Search
CPC ..... F24F 1/0047; F24F 1/0063; F24F 13/222; F24F 2013/227; F24F 1/039;
(Continued)

(56) References Cited

U.S. PATENT DOCUMENTS 4,679,405 A 7/1987 Mitchell et al.
2009/0007580 A1* 1/2009 Sakashita ..... F24F 13/222 62/259.1
2009/0025414 A1* 1/2009 Koga ..... F24F 1/0047 62/263

FOREIGN PATENT DOCUMENTS

CN 202158638 U 3/2012
CN 202254190 U 5/2012
(Continued)

OTHER PUBLICATIONS

Sheng, Lixing, CN107940567 Translation.pdf, "Conceled installation suspended ceiling type air conditioner indoor machine with water pump assembly", Apr. 2018, pp. 1-11.*
(Continued)

*Primary Examiner* — Avinash A Savani
*Assistant Examiner* — Ryan L Faulkner
(74) *Attorney, Agent, or Firm* — Scully, Scott, Murphy & Presser, P.C.

(57) ABSTRACT

A ceiling-embedded air conditioner is provided. The ceiling-embedded air conditioner has a housing, a heat exchanger, a drain pan and a water pump. The housing has a top plate and an enclosing plate connected to the top plate and surrounding the periphery of the top plate. The heat exchanger is arranged inside the housing. The heat exchanger and the enclosing plate together define an air outlet channel. The drain pan is arranged below the heat exchanger. The water pump is arranged outside the heat exchanger and is spaced apart from the heat exchanger. The water pump has a water inlet and a water outlet. The water inlet is in communication with the drain pan.

19 Claims, 8 Drawing Sheets

(58) Field of Classification Search
CPC ..... F24F 3/1411; F24F 2006/006; F24F 2006/008; F24F 6/02; F24F 2006/046
USPC ..... 454/292
See application file for complete search history.

(56) References Cited

FOREIGN PATENT DOCUMENTS

| | | | | | |
|---|---|---|---|---|---|
| CN | 203100086 | U | | 7/2013 | |
| CN | 203785217 | U | * | 8/2014 | ..... F24F 1/00 |
| CN | 204648621 | U | | 9/2015 | |
| CN | 206113265 | U | | 4/2017 | |
| CN | 207146618 | U | | 3/2018 | |
| CN | 107940567 | A | | 4/2018 | |
| CN | 208579403 | U | | 3/2019 | |
| EP | 1 983 269 | A1 | | 10/2008 | |
| JP | S63-134315 | A | | 6/1988 | |
| JP | H0828950 | B2 | | 3/1996 | |
| JP | H10-61968 | A | | 3/1998 | |
| JP | 2001-124365 | A | | 5/2001 | |
| JP | 2002-013756 | A | | 1/2002 | |
| JP | 2002130721 | A | | 5/2002 | |
| JP | 2007-192488 | A | | 8/2007 | |
| JP | 2011-169583 | A | | 9/2011 | |
| JP | 2012-093044 | A | | 5/2012 | |
| JP | 2016-223665 | A | | 12/2016 | |
| KR | 2002-0044798 | A | | 6/2002 | |
| WO | WO-2011013446 | A1 | * | 2/2011 | ..... F24F 1/0007 |
| WO | 2014/156542 | A1 | | 10/2014 | |

OTHER PUBLICATIONS

Higa, Yasushi, JP2016223665 Translation.pdf, "Air conditioner", Dec. 2016, pp. 1-11.*
Tanaka, Toshiyuki, JP2001124365 Translation.pdf, "Indoor unit for air conditioner", May 2001, pp. 1-12.*
Sakashita, Akihiko, WO2011013446 Translation.pdf, "Guide member", Feb. 2011, pp. 1-11.*
Wang, Huichen, CN203785217 Translation.pdf, "Ceiling machine and filtering plug thereof", Aug. 2014, pp. 1-9.*
International Search Report dated Apr. 16, 2019 received in International Application No. PCT/CN2018/112045 together with an English language translation.
Notice of the First Examination Opinion dated May 8, 2019 received in Chinese Patent Application No. CN 201810777360.0 together with an English language translation.
Extended European Search Report dated Jul. 22, 2021 received in European Patent Application No. EP 18926568.9.
Notice of Reasons for Refusal dated May 17, 2022 received in Japanese Patent Application No. JP 2021-502433.
Notice of Reasons for Refusal dated Feb. 15, 2022 received in Japanese Patent Application No. JP 2021-502433 together with an English language translation.

* cited by examiner

CEILING MACHINE

CROSS-REFERENCE TO RELATED APPLICATION

The present application is a continuation application of PCT International Application No. PCT/CN2018/112045, filed on Oct. 26, 2018, which is filed based on Chinese Patent Application Serial No. 201810777360.0 and 201821126537.2, both filed on Jul. 16, 2018, and claims priority to the Chinese Patent Application, the entire content of which is incorporated herein by reference for all purposes. No new matter has been introduced.

FIELD

The present disclosure relates to the field of air conditioning technologies, and more particularly to a ceiling-embedded air conditioner.

BACKGROUND

In the related art, an air inlet channel of a ceiling-embedded air conditioner is provided therein with a water pump to draw out condensate water in a drain pan. However, the water pump arranged in the air inlet channel may destroy the uniformity of airflow in the air inlet channel, making the energy consumption of the ceiling-embedded air conditioner higher, thus affecting the performance of the ceiling-embedded air conditioner.

SUMMARY

The present disclosure is intended to solve at least one of the technical problems existing in the prior art. Therefore, an objective of the present disclosure is to provide a ceiling-embedded air conditioner, which has the advantages of uniform air inlet and outlet, low energy consumption, and good working performance.

The ceiling-embedded air conditioner according to an embodiment of the present disclosure includes: a housing including a top plate and an enclosing plate, the enclosing plate being connected to the top plate and surrounding the periphery of the top plate; a heat exchanger arranged inside the housing and defining an air outlet channel with the enclosing plate; a drain pan arranged below the heat exchanger; and a water pump arranged outside the heat exchanger and spaced apart from the heat exchanger, the water pump having a water inlet and a water outlet, and the water inlet being in communication with the drain pan.

In the ceiling-embedded air conditioner according to an embodiment of the present disclosure, the water pump is arranged outside the heat exchanger and is spaced apart from the heat exchanger, so that the water pump no longer occupies the space in the air inlet channel, which can reduce a collision loss between airflow and the water pump, making the air intake more uniform, the air flow more smooth, and can thus reduce the energy consumption of the ceiling-embedded air conditioner and improve the working performance of the ceiling-embedded air conditioner. In addition, after heat exchange, part of the airflow can also be discharged indoors from an air channel separated by the water pump and the heat exchanger, so as to reduce the shielding of the water pump for the airflow in the air outlet channel, so that the air outlet channel of the ceiling-embedded air conditioner is formed as a circular communication channel, which effectively improves the air supply capability of the ceiling-embedded air conditioner, reduces air outlet noise and can make the air outlet of the ceiling-embedded air conditioner more uniform, further reduces the energy consumption of the ceiling-embedded air conditioner, and improves the working performance of the ceiling-embedded air conditioner.

According to some embodiments of the present disclosure, the ceiling-embedded air conditioner further includes a mounting shell arranged outside the enclosing plate and connected to the enclosing plate, and the water pump is arranged on the mounting shell.

Further, the mounting shell is provided with an outlet pipe, and the water outlet is in communication with the outlet pipe.

Further, the outlet pipe extends along an up-down direction.

In some embodiments of the present disclosure, the outlet pipe and the mounting shell are integrally formed.

In some embodiments of the present disclosure, the mounting shell includes: a first plate body with one end connected to the enclosing plate; and a second plate body with one end connected to the other end of the first plate body and the other end connected to the enclosing plate, a mounting space for mounting the water pump being defined between the second plate body and the first plate body.

In some embodiments of the present disclosure, the enclosing plate is provided with an opening portion, and a part of the water pump extends through the opening portion into the air outlet channel.

Further, a cross section of the enclosing plate is polygonal and the opening portion is formed at a corner of the enclosing plate.

In some embodiments of the present disclosure, one of the mounting shell and the enclosing plate is provided with a hook, and the other one of the mounting shell and the enclosing plate is provided with a hanging hole matching the hook.

In some embodiments of the present disclosure, the mounting shell is provided with a first screw hole, and the enclosing plate is provided with a second screw hole corresponding to the first screw hole.

In some embodiments of the present disclosure, the ceiling-embedded air conditioner further includes a first heat insulating member arranged on an inner wall of the mounting shell.

According to some embodiments of the present disclosure, the ceiling-embedded air conditioner further includes a second heat insulating member that includes: a body portion arranged on an inner wall of the top plate; and an extension portion with one end connected to the body portion and the other end extending downwardly, at least a part of the extension portion being located between the water pump and the heat exchanger.

Further, a width of the extension portion is greater than or equal to that of the water pump.

In some embodiments of the present disclosure, the other end of the extension portion extends to be flush with or beyond a lower end face of the heat exchanger.

In some embodiments of the present disclosure, the second heat insulating member is an integrally formed member.

According to some embodiments of the present disclosure, the ceiling-embedded air conditioner further includes a guide member with one end connected to the top plate and the other end extending downwardly, and at least a part of the guide member is located between the water pump and the heat exchanger.

According to some embodiments of the present disclosure, the drain pan includes: a first water receiving portion located below the heat exchanger; and a second water receiving portion in communication with the first water receiving portion, the second water receiving portion being located below the water pump, and the water inlet extending into the second water receiving portion.

Additional aspects and advantages of the present disclosure will be given in part in the following descriptions, and become apparent in part from the following descriptions, or be learned from the practice of the present disclosure.

BRIEF DESCRIPTION OF THE DRAWINGS

The above and/or additional aspects and advantages of the present disclosure will become apparent and more readily appreciated from the following descriptions of embodiments made with reference to the drawings, in which.

Figure 1:
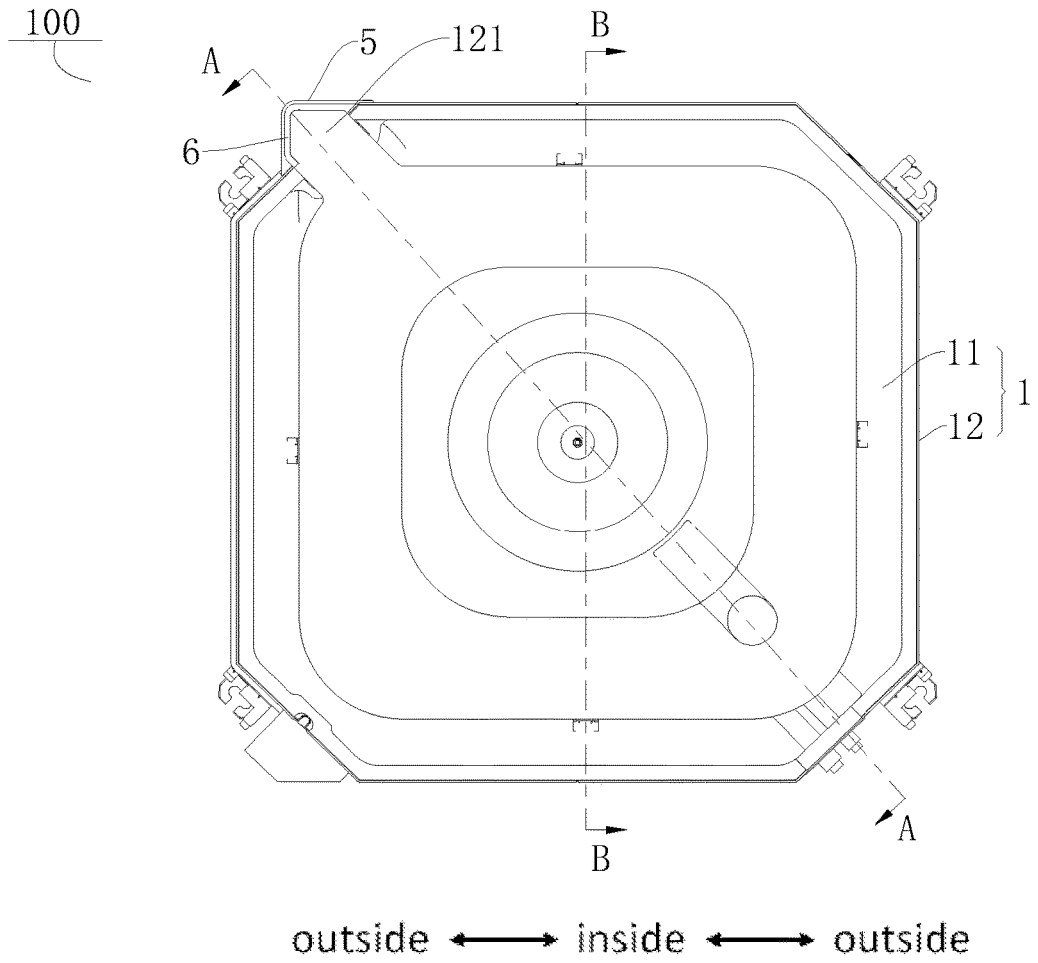
FIG. 1 is a bottom view of a ceiling-embedded air conditioner according to an embodiment of the present disclosure.

The following is description of reference numerals of the figures:

ceiling-embedded air conditioner 100, housing 1, top plate 11, enclosing plate 12, opening portion 121, second screw hole 122, panel assembly 13, air inlet channel 131, heat exchanger 2, air outlet channel 21, drain pan 3, first water receiving portion 31, second water receiving portion 32, water pump 4, water inlet 41, water outlet 42, connecting plate 43, connecting pipe 44, mounting shell 5, first plate body 51, second plate body 52, outlet pipe 53, fixed plate 54, elastic support member 55, hook 56, first screw hole 57, first heat insulating member 6, second heat insulating member 7, body portion 71, extension portion 72.

DETAILED DESCRIPTION OF EMBODIMENTS

Reference will be made in detail to embodiments of the present disclosure, and the examples of the embodiments are illustrated in the drawings, wherein the same or similar elements and the elements having same or similar functions are denoted by like reference numerals throughout the descriptions. The embodiments described below with reference to drawings are illustrative, and merely used to explain the present disclosure. The embodiments shall not be construed to limit the present disclosure.

A ceiling-embedded air conditioner 100 according to an embodiment of the present disclosure is described below with reference to FIG. 1 to FIG. 14. The ceiling-embedded air conditioner 100 may be mounted on a ceiling or a wall of a premise.

The ceiling-embedded air conditioner 100 according to the embodiment of the present disclosure includes: a housing 1, a heat exchanger 2, a drain pan 3, and a water pump 4.

Figure 2:
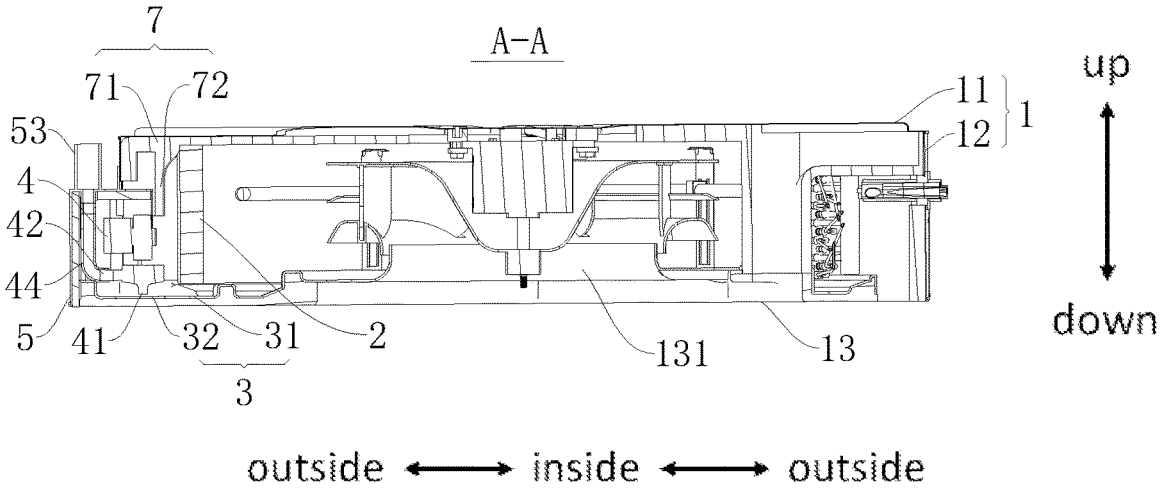
FIG. 2 is a sectional view at A-A in FIG. 1.

As shown in FIG. 1 and FIG. 2, the housing 1 includes a top plate 11 and an enclosing plate 12. The enclosing plate 12 is connected or coupled to the top plate 11 and surrounds the periphery of the top plate 11. Both a top opening and a bottom opening are defined by the enclosing plate 12. The top plate 11 is arranged at the top opening of the enclosing plate 12. A mounting space is defined between the enclosing plate 12 and the top plate 11. A panel assembly 13 of the ceiling-embedded air conditioner 100 is detachably arranged at the bottom opening of the enclosing plate 12. It is understandable that the enclosing plate 12 surrounds the periphery of the top plate 11, so that the collision between an external object and a component in the housing 1 can be avoided, which can improve the reliability of the ceiling-embedded air conditioner 100 during transportation or mounting. Moreover, the housing 1 may also insulate internal components from the external dust, so as to improve the operational stability of the ceiling-embedded air conditioner 100.

Figure 3:
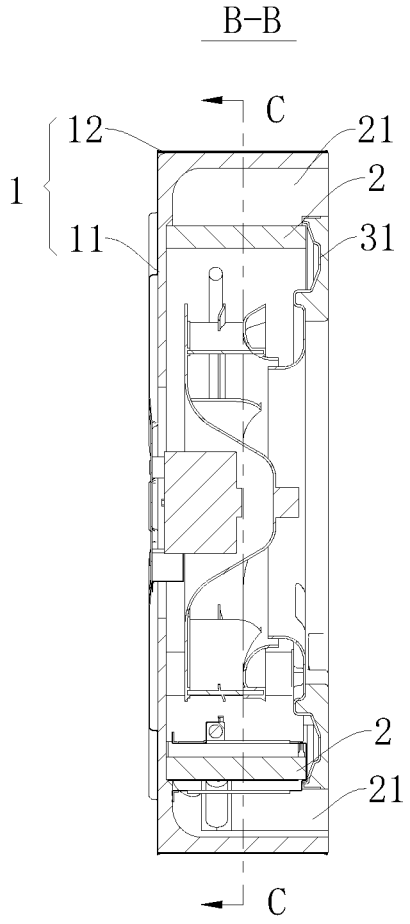
FIG. 3 is a sectional view at B-B in FIG. 1.
Figure 5:
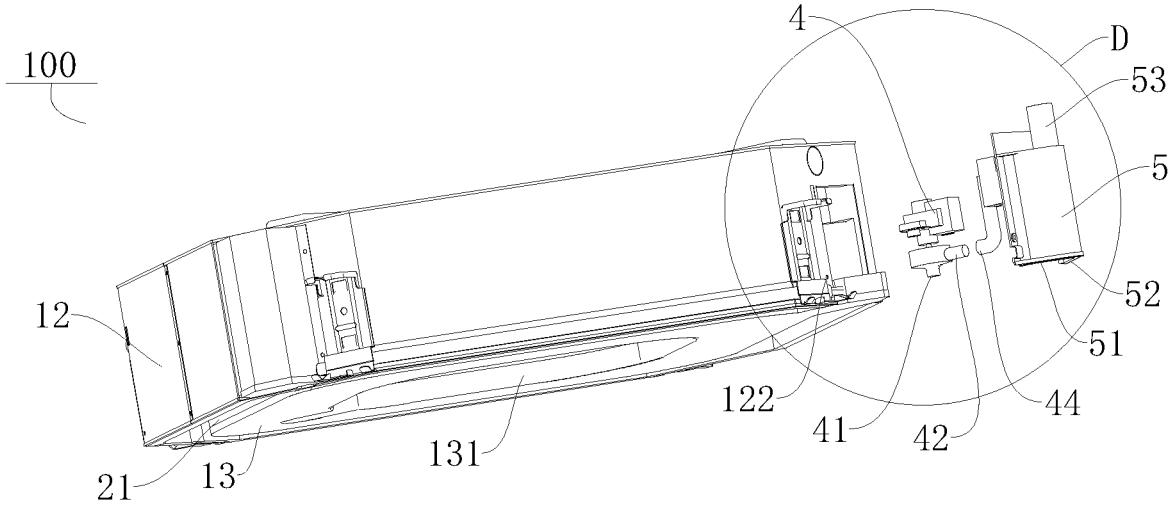
FIG. 5 is a partial exploded view of a ceiling-embedded air conditioner according to the embodiment of the present disclosure.

As shown in FIG. 2, FIG. 3, and FIG. 5, the heat exchanger 2 is arranged in the housing 1, and the heat exchanger 2 and the enclosing plate 12 collectively define an air outlet channel 21. An inner side of the heat exchanger 2 defines an air inlet channel 131. An air inlet and an air outlet may be formed on the panel assembly 13. The air outlet channel 21 is in communication with the air outlet, and the air inlet channel 131 is in communication with the air inlet. The indoor air may flow into the air inlet channel 131 through the air inlet. The air entering the air inlet channel 131 exchanges heat with the heat exchanger 2 and subsequently flows to the air outlet channel 21, and finally is discharged to an indoor space through the air outlet to adjust the temperature of the indoor environment.

The drain pan 3 is arranged below the heat exchanger 2 with respect to the upward and downward direction as shown in FIG. 2. In other words, the drain pan 3 is arranged at a position downstream of the heat exchanger 2 for allowing any condensate water to flow under gravity into the drain pan 3 from the heat exchanger 2. Thus, the drain pan 3 may collect the condensate water falling from a surface of the heat exchanger 2, so as to prevent the condensate water from being directly discharged indoors, thereby improving the security and reliability of the ceiling-embedded air conditioner 100. For example, in the embodiment shown in FIG. 4, the enclosing plate 12, the heat exchanger 2, and the drain pan 3 are all circular, and correspondingly, the air outlet channel 21 defined by the heat exchanger 2 and the enclosing plate 12 is also circular.

It shall be noted that in a refrigeration mode, when the airflow enters the housing 1 to exchange heat with the heat exchanger 2, the airflow of a higher temperature contacts the heat exchanger 2 of a lower temperature, water vapor in the airflow may be liquefied, and condensate water in the shape of liquid beads or drops may be formed on the surface of the heat exchanger 2. With the gradual increase of the condensate water, the liquid beads may gradually accumulate and become enlarged, begin to fall under the action of gravity, and fall into the drain pan 3.

As shown in FIG. 2, FIG. 4, FIG. 6, and FIG. 7, the water pump 4 has a water inlet 41 and a water outlet 42. The water inlet 41 is in communication with the drain pan 3. The water outlet 42 may be in communication with a water supply pipe outside the ceiling-embedded air conditioner 100. Thus, the condensate water in the drain pan 3 may be transported outside the ceiling-embedded air conditioner 100 through the water pump 4, so that the condensate water in the drain pan 3 can be discharged in time to avoid overflow of the condensate water.

The water pump 4 is arranged outside (the outside as shown in FIG. 2) the heat exchanger 2 and is spaced apart from the heat exchanger 2. For example, the water pump 4 may be arranged outside the heat exchanger 2, and the entire water pump 4 is located inside the enclosing plate 12; or the water pump 4 is arranged outside the heat exchanger 2, one part of the water pump 4 is located inside the enclosing plate 12, and the other part of the water pump 4 is located outside the enclosing plate 12; or the entire water pump 4 is located outside the enclosing plate 12.

Thus, the water pump 4 no longer occupies the space in the air inlet channel 131, so that the air intake is more uniform and the airflow is more smooth, which can reduce the energy consumption of the ceiling-embedded air conditioner 100 and improve the working performance of the ceiling-embedded air conditioner 100. In addition, after heat exchange, part of the airflow can also be discharged indoors from an air channel separated by and provided between the water pump 4 and the heat exchanger 2, so as to reduce the shielding or blocking of the air flow in the air outlet channel by the water pump 4, so that the air outlet channel 21 of the ceiling-embedded air conditioner 100 is formed as a circular communication channel, which effectively improves the air supply capability of the ceiling-embedded air conditioner 100, reduces air outlet noise and can make the air outlet of the ceiling-embedded air conditioner 100 more uniform, further reduces the energy consumption of the ceiling-embedded air conditioner 100, and improves the working performance of the ceiling-embedded air conditioner 100.

In the ceiling-embedded air conditioner 100 according to an embodiment of the present disclosure, the water pump 4 is arranged outside the heat exchanger 2 and is spaced apart from the heat exchanger 2, so that the water pump 4 no longer occupies the space in the air inlet channel 131, which can reduce a collision loss between airflow and the water pump 4, making the air intake more uniform, the air flow more smooth, and can thus reduce the energy consumption of the ceiling-embedded air conditioner 100 and improve the working performance of the ceiling-embedded air conditioner 100. In addition, after heat exchange, part of the airflow can also be discharged indoors from an air channel separated by the water pump 4 and the heat exchanger 2, so as to reduce the shielding or blocking of the airflow in the air out let channel 21 by the water pump 4, so that the air outlet channel 21 of the ceiling-embedded air conditioner 100 is formed as a circular communication channel, which effectively improves the air supply capability of the ceiling-embedded air conditioner 100, reduces air outlet noise and can make the air outlet of the ceiling-embedded air conditioner 100 more uniform, further reduces the energy consumption of the ceiling-embedded air conditioner 100, and improves the working performance of the ceiling-embedded air conditioner 100.

According to some embodiments of the present disclosure, as shown in FIG. 2, FIG. 4, FIG. 5, and FIG. 10, the ceiling-embedded air conditioner 100 further includes a mounting shell 5. The mounting shell 5 is arranged outside the enclosing plate 12 and is connected to the enclosing plate 12. The water pump 4 is arranged on the mounting shell 5. Thus, a support for fixing the water pump arranged on the top plate of the ceiling-embedded air conditioner in the related art can be removed, so that the water pump 4 can be installed directly on the mounting shell 5, thereby reducing the mounting difficulty or complexity of the water pump 4, improving the mounting efficiency of the water pump 4, and reducing mounting costs of the water pump 4. In addition, it is easier to uninstall the mounting shell 5, which can reduce the difficulty of inspection and service of the water pump 4, thus improving the efficiency of the inspection and service of the water pump 4 and reducing maintenance costs of the water pump 4.

Figure 10:
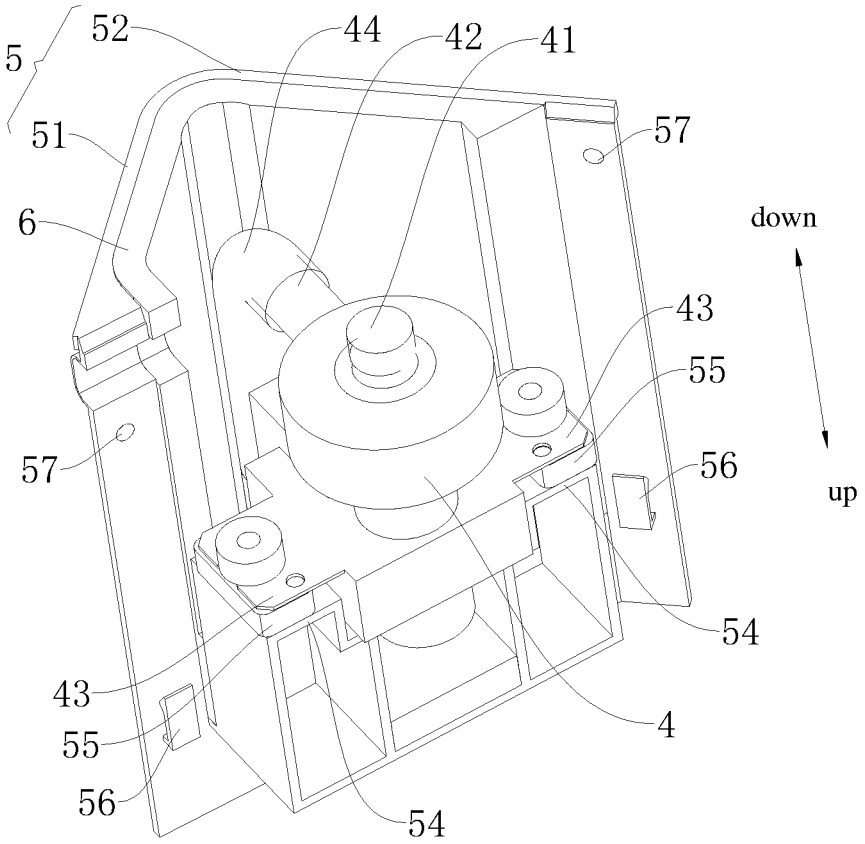
FIG. 10 is a three-dimensional view of a mounting shell, a water pump, and a first heat insulating member of the ceiling-embedded air conditioner according to the embodiment of the present disclosure.

For example, in the embodiment shown in FIG. 10, the water pump 4 is provided with a connecting plate 43, the mounting shell 5 is further provided with a fixed plate 54, and the connecting plate 43 may be coordinated with the fixed plate 54 to connect and fix the mounting shell 5 to the water pump 4. In addition, the mounting shell 5 is further provided with an elastic support member 55. The elastic support member 55 is arranged between the connecting plate 43 and the fixed plate 54. Thus, tight connection between the mounting shell 5 and the water pump 4 can be achieved, vibration of the water pump 4 can be reduced, and vibration noise can be reduced.

Figure 11:
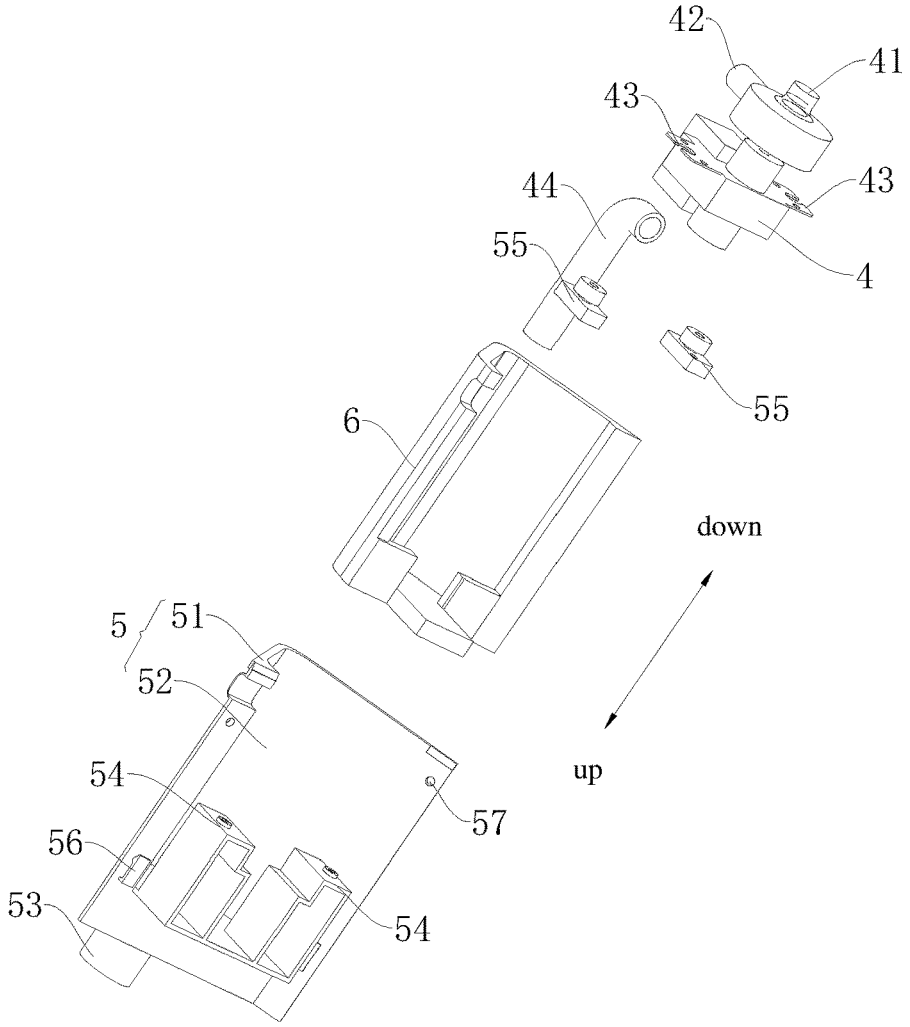
FIG. 11 is an exploded view of the mounting shell, the water pump, and the first heat insulating member of the ceiling-embedded air conditioner according to the embodiment of the present disclosure.

Further, as shown in FIG. 10 and FIG. 11, the mounting shell 5 is provided with an outlet pipe 53. The water outlet 42 is in communication with the outlet pipe 53. For example, the water outlet 42 may be in communication with the outlet pipe 53 through a connecting pipe 44. In some embodiments of the present disclosure, the connecting pipe 44 is a rubber pipe. The outlet pipe 53 has a guiding effect on the flow of the condensate water. It is understandable that after the water pump 4 draws the condensate water in the drain pan 3, the water pump may discharge the condensate water from the water outlet 42 to the outlet pipe 53 of the mounting shell 5, and subsequently the condensate water is discharged outdoors through the guiding effect of the outlet pipe 53. Thus, the condensate water can move according to a predetermined flow direction through the guiding effect of the outlet pipe 53.

In some embodiments of the present disclosure, as shown in FIG. 11, the water pump 4 is provided with a water pump inlet pipe and a water pump outlet pipe. The water pump inlet pipe may extend in an up-down direction, and the water pump outlet pipe may extend in a horizontal direction that is perpendicular to the up-down direction. The water inlet 41 is formed on one end (for example, the lower end in FIG. 11)

of the water pump inlet pipe, and the water outlet 42 is formed on one end of the water pump outlet pipe.

Figure 6:
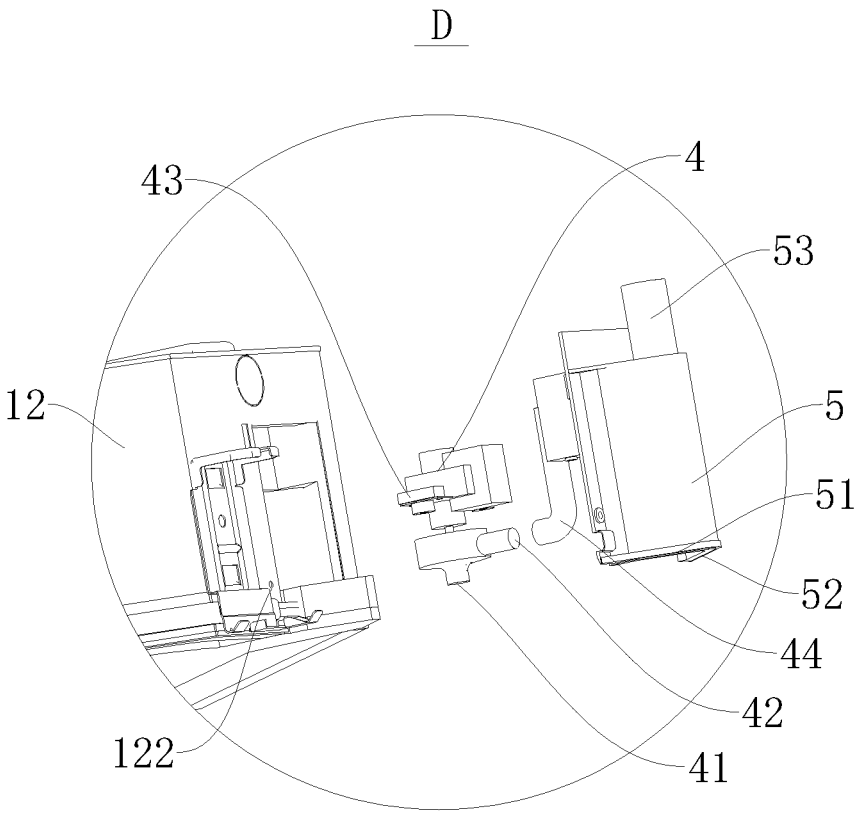
FIG. 6 is an enlarged view at D in FIG. 5.
Figure 7:
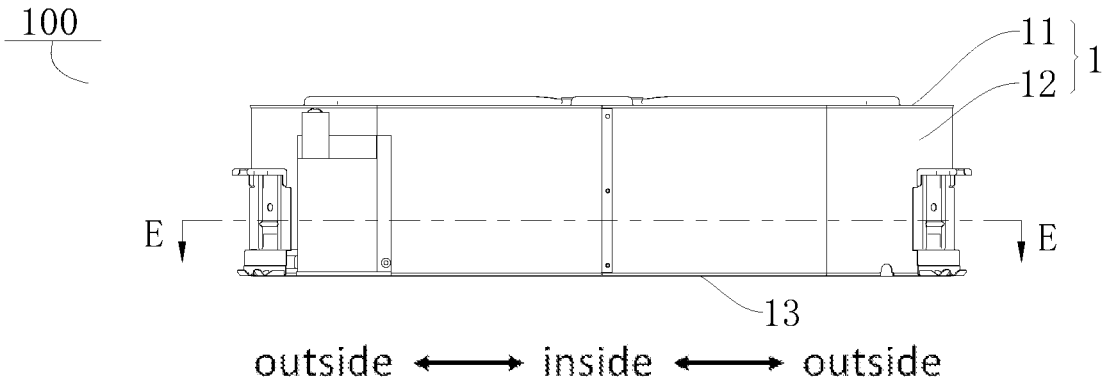
FIG. 7 is a front view of a ceiling-embedded air conditioner according to the embodiment of the present disclosure.
Figure 9:
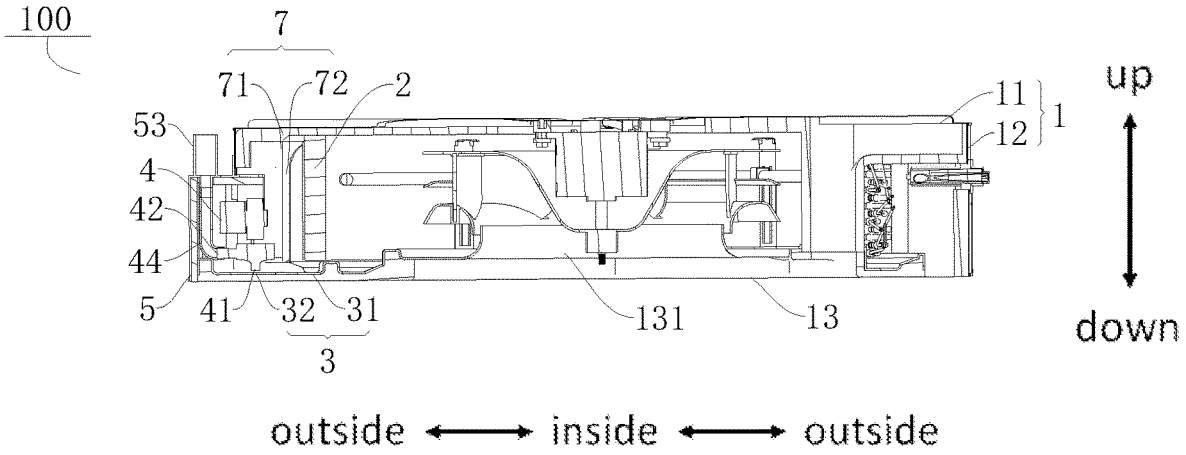
FIG. 9 is a sectional view of a ceiling-embedded air conditioner according to another embodiment of the present disclosure.

Further, as shown in FIG. 5, FIG. 6, and FIG. 9, the outlet pipe 53 extends in an up-down direction (the up-down direction as shown in FIG. 9). Thus, the condensate water may flow in the up-down direction, so as to avoid liquid production in the outlet pipe 53 or the water pump 4 by the condensate water and to extend the service life of the outlet pipe 53 and the water pump 4.

It shall be noted that when the water pump 4 stops working, the condensate water in the outlet pipe 53 may flow back to the water outlet 42 of the water pump 4 under the action of gravity, and push the condensate water remaining in the water pump 4 to flow back together to the drain pan 3.

In some embodiments of the present disclosure, as shown in FIG. 6, the outlet pipe 53 and the mounting shell 5 are integrally formed. The integrally formed structure can not only guarantee structural and performance stability of the outlet pipe 53 and the mounting shell 5, but also facilitate the forming and manufacturing. Also, redundant assembly parts and connection procedures are eliminated, greatly improving the assembly efficiency of the outlet pipe 53 and the mounting shell 5, and ensuring the connection reliability of the outlet pipe 53 and the mounting shell 5. In addition, the integrally formed structure has higher overall strength and stability, is easier to assemble, and has a longer service life.

Figure 12:
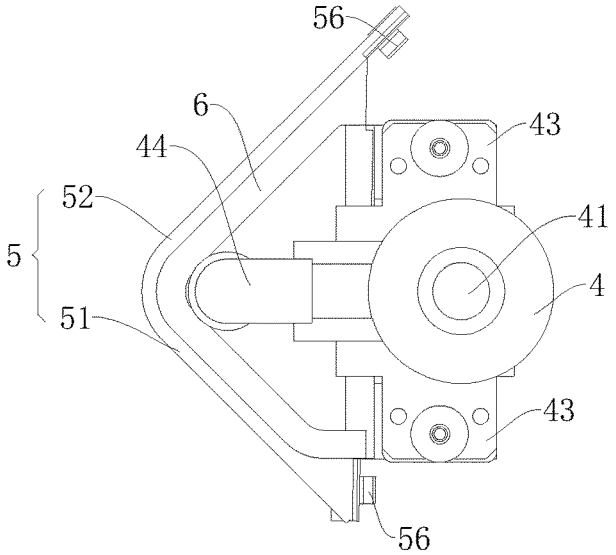
FIG. 12 is a top view of the mounting shell, the water pump, and the first heat insulating member of the ceiling-embedded air conditioner according to the embodiment of the present disclosure.
Figure 13:
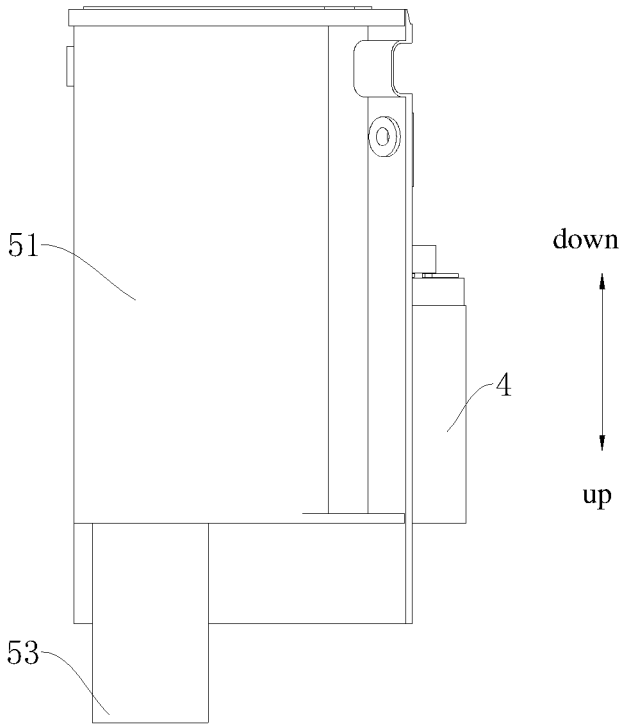
FIG. 13 is a front view of the mounting shell, the water pump, and the first heat insulating member of the ceiling-embedded air conditioner according to the embodiment of the present disclosure.
Figure 14:
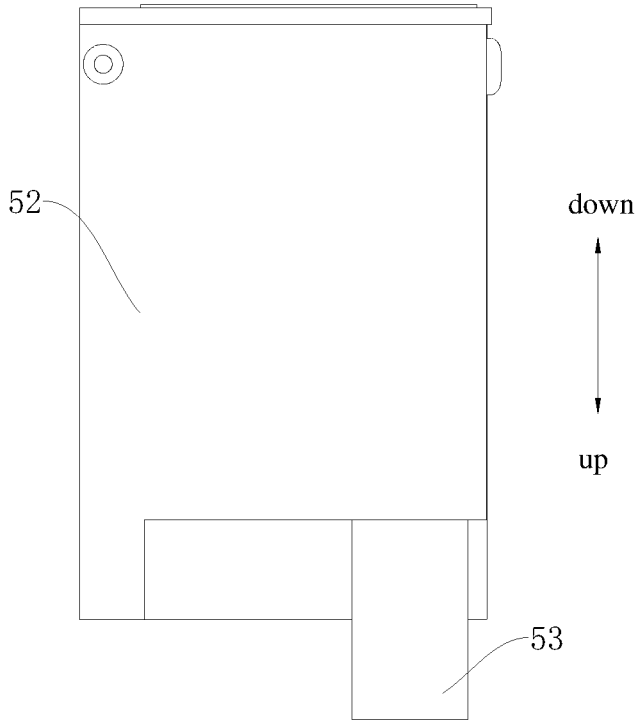
FIG. 14 is a rear view of the mounting shell, the water pump, and the first heat insulating member of the ceiling-embedded air conditioner according to the embodiment of the present disclosure.

In some embodiments of the present disclosure, as shown in FIG. 6, FIG. 11, and FIG. 12, the mounting shell 5 includes: a first plate body 51 and a second plate body 52. One end of the first plate body 51 is connected to the enclosing plate 12. One end of the second plate body 52 is connected to the other end of the first plate body 51. The other end of the second plate body 52 is connected to the enclosing plate 12. A mounting space for mounting the water pump 4 is defined between the second plate body 52 and the first plate body 51. Thus, the first plate body 51 and the second plate body 52 have a protective effect on the water pump 4, which can avoid the collision between an external object and the water pump 4, thus improving the reliability of the water pump 4 during transportation. In addition, the first plate body 51 and the second plate body 52 may also avoid exposure of the water pump 4 to a visual range of a user, thus improving the artistic appearance of the ceiling-embedded air conditioner 100.

For example, in the embodiment shown in FIG. 12, the first plate body 51 is perpendicular to the second plate body 52

Figure 4:
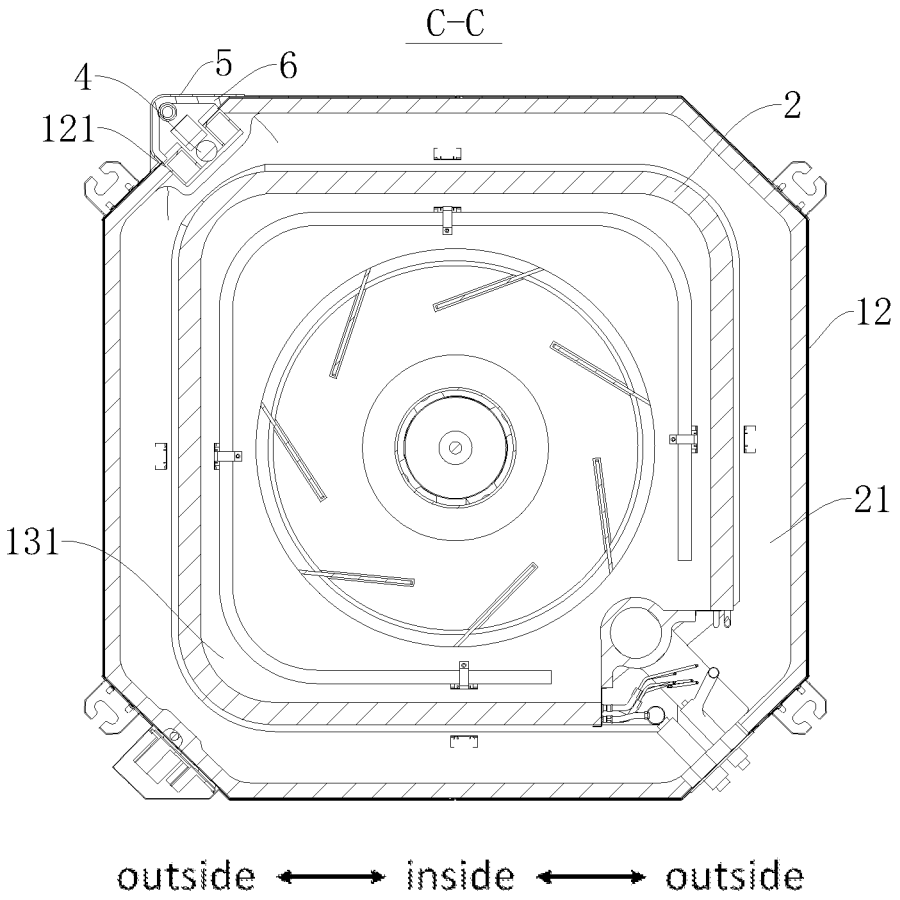
FIG. 4 is a sectional view at C-C in FIG. 3.

In some embodiments of the present disclosure, as shown in FIG. 1 and FIG. 4, the enclosing plate 12 is provided with an opening portion 121. A part of the water pump 4 extends through the opening portion 121 into the air outlet channel 21. Thus, this can not only reduce the space of the air outlet channel 21 occupied by the water pump 4 and reduce the shielding of the airflow in the air outlet channel 21 by the water pump 4, making the airflow flow more smoothly to reduce the energy consumption of the ceiling-embedded air conditioner 100 and improve the working performance of the ceiling-embedded air conditioner 100, but also reduce the space occupied by the ceiling-embedded air conditioner 100 and improve the compactness of the ceiling-embedded air conditioner 100.

Figure 8:
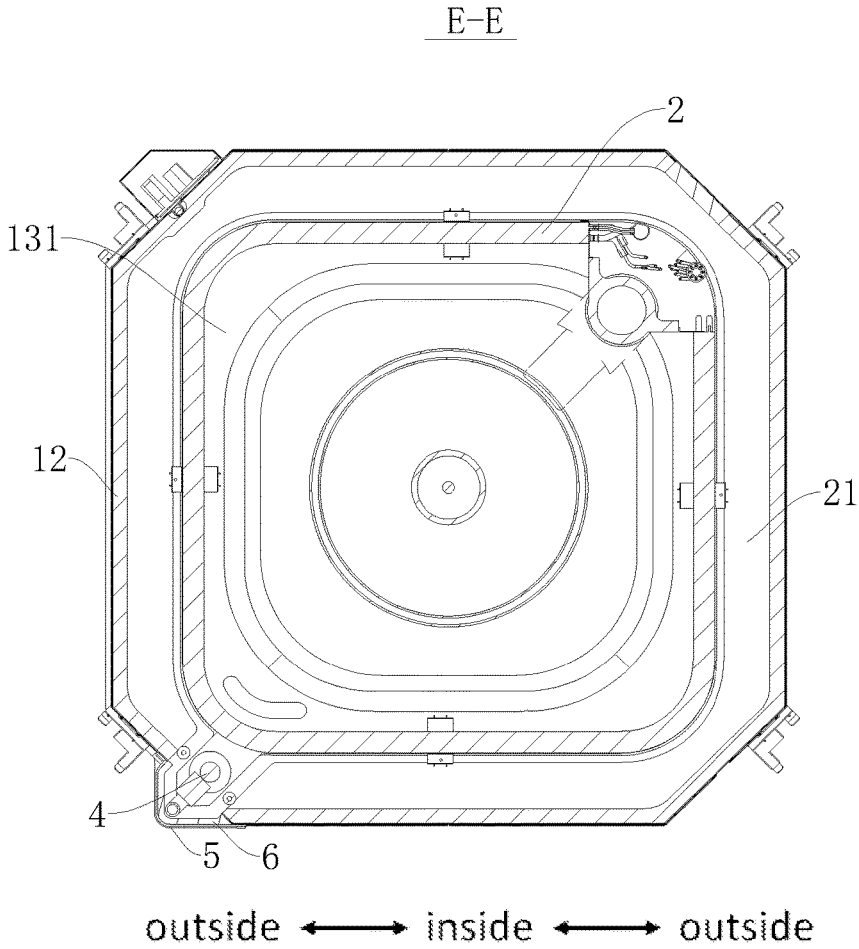
FIG. 8 is a sectional view at E-E in FIG. 7.

Further, as shown in FIG. 1, FIG. 4, and FIG. 8, a cross section of the enclosing plate 12 is polygonal. For example, the enclosing plate 12 may be form as an octagon. The opening portion 121 is formed at a corner of the enclosing plate 12. It is understandable that the arrangement of the opening portion 121 at a corner of the enclosing plate 12 can avoid excessive protrusion of the water pump 4 on an appearance surface of the ceiling-embedded air conditioner 100, so as to reduce the space occupied by the ceiling-embedded air conditioner 100, making the ceiling-embedded air conditioner 100 more compact and beautiful.

In some embodiments of the present disclosure, as shown in FIG. 8 and FIG. 10, one of the mounting shell 5 and the enclosing plate 12 is provided with a hook 56, and the other one of the mounting shell 5 and the enclosing plate 12 is provided with a hanging hole matching the hook 56. It is understandable that the mounting shell 5 may be provided with a hook 56 and the enclosing plate 12 may be provided with a hanging hole matching the hook 56; or the enclosing plate 12 may be provided with a hook 56 and the mounting shell 5 may be provided with a hanging hole matching the hook 56. Thus, the hook 56 may match the hanging hole to implement an aligned connection between the mounting shell 5 and the enclosing plate 12, so as to reduce the mounting difficulty of the mounting shell 5 and improve the mounting efficiency of the mounting shell 5.

In some embodiments of the present disclosure, as shown in FIG. 6 and FIG. 11, the mounting shell 5 is provided with a first screw hole 57, and the enclosing plate 12 is provided with a second screw hole 122 corresponding to the first screw hole 57. It is understandable that during mounting of the mounting shell 5, a fastener may be arranged through a first threaded hole of the mounting shell 5 and the second screw hole 122 of the enclosing plate 12, so as to achieve connection and fixation of the mounting shell 5 and the enclosing plate 12. Thus, the mounting difficulty of the mounting shell 5 can be reduced, and the mounting efficiency of the mounting shell 5 is improved. In addition, during removal of the mounting shell 5, only the fastener arranged through the first threaded hole and the second screw hole 122 needs to be removed. The operation is relatively simple, so as to facilitate the removal of the water pump 4.

For example, in the embodiments shown in FIG. 6 and FIG. 11, two hooks 56 are spaced apart near an upper end (the upper end as shown in FIG. 11) of the mounting shell 5, two first screw holes 57 are spaced apart near a lower end (the upper end as shown in FIG. 11) of the mounting shell 5, and the enclosing plate 12 is provided with hanging holes and second screw holes 122 matching the hooks 56 and the first screw holes 57 respectively.

During the installation of the mounting shell 5, firstly, the hook 56 on the mounting shell 5 may be hung into the hanging hole of the enclosing plate 12, so as to achieve alignment and fixation of the mounting shell 5 and an upper end portion of the enclosing plate 12. Subsequently, a fastener is arranged through the first screw hole 57 and the second screw hole 122 to fix the mounting shell 5 to a lower end portion of the enclosing plate 12, so as to achieve a fixed connection between the mounting shell 5 and the enclosing plate 12.

During removal of the mounting shell 5, firstly, the fastener arranged through the first screw hole 57 and the second screw hole 122 may be removed. Subsequently, in a vertical direction (the up-down direction as shown in FIG. 11), the mounting shell 5 is lifted upwardly, so that the hook 56 of the mounting shell 5 is removed from the hanging hole of the enclosing plate 12, thereby completing the removal of the mounting shell 5. Thus, the structure of the mounting shell 5 can be simplified, making it more convenient to disassemble and assemble the mounting shell 5.

In some embodiments of the present disclosure, as shown in FIG. 1 and FIG. 11, the ceiling-embedded air conditioner 100 further includes a first heat insulating member 6. The first heat insulating member 6 is arranged on an inner wall of the mounting shell 5. It is understandable that the first heat insulating member 6 has a function of heat insulation. The first heat insulating member 6 may separate the airflow after heat exchange from the mounting shell 5, so that the heat exchange amount between the airflow after heat exchange and the mounting shell 5 is reduced, effectively reducing the energy loss, which can better achieve the heat exchange of indoor air and can also speed up regulation of the ceiling-embedded air conditioner 100 to the indoor temperature. In some embodiments of the present disclosure, the first heat insulating member 6 is a foam member or a plastic member.

According to some embodiments of the present disclosure, as shown in FIG. 2 and FIG. 9, the ceiling-embedded air conditioner 100 further includes a second heat insulating member 7. The second heat insulating member 7 includes: a body portion 71 and an extension portion 72. The body portion 71 is arranged on an inner wall of the top plate 11. One end of the extension portion 72 is connected to the body portion 71. The other end of the extension portion 72 extends downwardly. At least a part of the extension portion 72 is located between the water pump 4 and the heat exchanger 2. It is understandable that only part of the extension portion 72 may be located between the water pump 4 and the heat exchanger 2, or the entire extension portion 72 may be located between the water pump 4 and the heat exchanger 2. Thus, the airflow after heat exchange may move along a predetermined direction under a guiding effect of the second heat insulating member 7, which can avoid direct blowing of the airflow after heat exchange on the water pump 4 and can avoid generation of vortex at the position of the water pump 4 by the airflow, so as to reduce the energy consumption of the ceiling-embedded air conditioner 100 and improve the working performance of the ceiling-embedded air conditioner 100.

For example, in the embodiment shown in FIG. 2, one end of the extension portion 72 is connected to the body portion 71, the other end of the extension portion 72 extends downwardly, and in the vertical direction, a length of the extension portion 72 is substantially half a length of the heat exchanger 2.

Further, a width of the extension portion 72 is greater than or equal to that of the water pump 4. Thus, the extension portion 72 can better shield the width direction of the water pump 4, so that the airflow after heat exchange cannot directly blow the water pump 4, which can further reduce a collision loss between the airflow and the water pump 4, reduce the energy consumption of the ceiling-embedded air conditioner 100, and improve the working performance of the ceiling-embedded air conditioner 100.

In some embodiments of the present disclosure, as shown in FIG. 9, the other end (the lower end as shown in FIG. 9) of the extension portion 72 extends to be flush with a lower end face (the lower end face as shown in FIG. 9) of the heat exchanger 2 or beyond the lower end face of the heat exchanger 2. Thus, the extension portion 72 can better shield the length direction of the water pump 4, so that the airflow after heat exchange can be discharged indoors from the air outlet of the ceiling-embedded air conditioner 100 under the guiding effect of the extension portion 72, which can avoid direct blowing of the airflow after heat exchange on the water pump 4 and can avoid generation of vortex at the position of the water pump 4 by the airflow, further reducing the energy loss of the airflow, reducing the energy consumption of the ceiling-embedded air conditioner 100, and improving the working performance of the ceiling-embedded air conditioner 100.

In some embodiments of the present disclosure, as shown in FIG. 9, the second heat insulating member 7 is an integrally formed member. Thus, an integrally formed structure can not only guarantee structural and performance stability of the body portion 71 and the extension portion 72, but also facilitate the forming and manufacturing. Also, redundant assembly parts and connection procedures are eliminated, greatly improving the assembly efficiency of the body portion 71 and the extension portion 72, and ensuring the connection reliability of the body portion 71 and the extension portion 72. Besides, the integrally formed structure has higher overall strength and stability, is easier to assemble, and has a longer service life. In some embodiments of the present disclosure, the second heat insulating member 7 is a foam member or a plastic member.

According to some embodiments of the present disclosure, the ceiling-embedded air conditioner 100 further includes a guide member. One end of the guide member is connected to the top plate 11, the other end of the guide member extends downwardly, and at least a part of the guide member is located between the water pump 4 and the heat exchanger 2. It is understandable that only part of the guide member may be located between the water pump 4 and the heat exchanger 2, or the entire guide member may be located between the water pump 4 and the heat exchanger 2. Thus, the airflow after heat exchange may move along a predetermined direction under a guiding effect of the guide member, which can avoid direct blowing of the airflow after heat exchange on the water pump 4 or generation of vortex at the position of the water pump 4, so as to reduce the energy consumption of the ceiling-embedded air conditioner 100 and improve the working performance of the ceiling-embedded air conditioner 100.

According to some embodiments of the present disclosure, as shown in FIG. 2 and FIG. 9, the drain pan 3 includes: a first water receiving portion 31 and a second water receiving portion 32. The first water receiving portion 31 is located below or downstream of the heat exchanger 2 in the flowing direction of the condensate water. The second water receiving portion 32 is in communication with the first water receiving portion 31. The second water receiving portion 32 is located below the water pump 4 and the water inlet 41 extends into the second water receiving portion 32. Thus, the water inlet 41 of the water pump 4 can directly extend into the second water receiving portion 32 of the drain pan 3, so that the water pump 4 can draw out the condensate water from the drain pan 3 through the water inlet 41. This does not need to arrange a connecting pipe between the water inlet 41 of the water pump 4 and the drain pan 3 and can thus simplify the structure of the ceiling-embedded air conditioner 100 and improve the assembly efficiency of the ceiling-embedded air conditioner 100.

In the description of the present disclosure, it is to be understood that terms (such as "length," "width," "upper," "lower," "inner," and "outer") should be construed to refer to the orientation as then described or as shown in the drawings under discussion. These relative terms are for convenience of description and do not require that the present disclosure be constructed or operated in a particular orientation, thus cannot be construed to limit the present disclosure.

A specific structure of the ceiling-embedded air conditioner 100 according to the embodiments of the present disclosure is described below with reference to FIG. 1 to FIG. 14. Certainly, it is understandable that the following description is intended to interpret the present disclosure and should not be used as a limitation on the present disclosure.

As shown in FIG. 1, FIG. 2, and FIG. 4, the ceiling-embedded air conditioner 100 according to the embodiment of the present disclosure includes: a housing 1, a heat exchanger 2, a drain pan 3, a water pump 4, a mounting shell 5, a first heat insulating member 6, and a second heat insulating member 7.

As shown in FIG. 2, FIG. 4, and FIG. 5, the housing 1 includes a top plate 11, an enclosing plate 12, and a panel assembly 13. The enclosing plate 12 is formed as an octagon. The top and the bottom of the enclosing plate 12 are both open. The top plate 11 is arranged at the top opening of the enclosing plate 12. A mounting space is defined between the enclosing plate 12 and the top plate 11. The enclosing plate 12 is provided with an opening portion 121. The opening portion 121 is formed at a corner of the enclosing plate 12. The panel assembly 13 is arranged at the bottom opening of the enclosing plate 12. The panel assembly 13 is provided with an air inlet in communication with an air inlet channel 131 and an air outlet in communication with an air outlet channel 21.

As shown in FIG. 2, FIG. 4, and FIG. 6, the heat exchanger 2 is circular, the heat exchanger 2 is arranged in the housing 1 and located above (as shown in FIG. 2) the panel assembly 13, and the heat exchanger 2 and the enclosing plate 12 define a circular air outlet channel 21. The water pump 4 is arranged outside (the outside as shown in FIG. 4) the heat exchanger 2 and is spaced apart from the heat exchanger 2. The water pump 4 is provided with a water pump inlet pipe and a water pump outlet pipe. The water pump inlet pipe may extend along an up-down direction, and the water pump outlet pipe may extend along a horizontal direction. The water inlet 41 is formed on one end (for example, the lower end in FIG. 11) of the water pump inlet pipe, and the water outlet 42 is formed on one end of the water pump outlet pipe. The water pump inlet pipe is located inside the enclosing plate 12 and outside the heat exchanger 2. The water pump outlet pipe is located outside the enclosing plate 12.

As shown in FIG. 8, FIG. 10, and FIG. 11, the mounting shell 5 is arranged outside the enclosing plate 12 and is connected to the enclosing plate 12. The water pump 4 and the first heat insulating member 6 are both arranged on the mounting shell 5, and the first heat insulating member 6 is located between the water pump 4 and the mounting shell 5. The mounting shell 5 is further provided with an outlet pipe 53. The outlet pipe 53 extends along an up-down direction (the up-down direction as shown in FIG. 11), and the outlet pipe 53 and the water outlet 42 of the water pump 4 are in communication through a connecting pipe 44.

For example, as shown in FIG. 6 and FIG. 11, the mounting shell 5 includes: a first plate body 51 and a second plate body 52. One end of the first plate body 51 is connected to the enclosing plate 12. One end of the second plate body 52 is connected to the other end of the first plate body 51. The other end of the second plate body 52 is connected to the enclosing plate 12. A mounting space for mounting the water pump 4 is defined between the second plate body 52 and the first plate body 51. The mounting shell 5 is provided with two hooks 56 and a first screw hole 57. The enclosing plate 12 is provided with hanging holes and a second screw hole 122 respectively matching the hooks 56 and the first screw hole 57.

As shown in FIG. 2, the drain pan 3 includes: a first water receiving portion 31 and a second water receiving portion 32. The first water receiving portion 31 is located below the heat exchanger 2. The second water receiving portion 32 is in communication with the first water receiving portion 31. The second water receiving portion 32 is located below the water pump 4 and the water inlet 41 extends into the second water receiving portion 32.

As shown in FIG. 2, the second heat insulating member 7 includes: a body portion 71 and an extension portion 72. The body portion 71 and the extension portion 72 are integrally formed members. The body portion 71 is arranged on an inner wall of the top plate 11. One end of the extension portion 72 is connected to the body portion 71. The other end of the extension portion 72 extends downwardly. A part of the extension portion 72 is located between the water pump 4 and the heat exchanger 2. A width of the extension portion 72 is equal to that of the water pump 4. In a vertical direction, a length of the extension portion 72 is substantially half a length of the heat exchanger 2.

In the description of the present specification, reference throughout this specification to "an embodiment," "some embodiments," "exemplary embodiment," "example," "specific example" or "some examples" means that a particular feature, structure, material, or characteristic described in connection with the embodiment or example is included in at least one embodiment or example of the present disclosure. In the present specification, the schematic expressions to the above-mentioned terms are not necessarily referring to the same embodiment or example. Furthermore, the described particular features, structures, materials, or characteristics may be combined in any suitable manner in one or more embodiments or examples.

Although embodiments of the present disclosure have been shown and illustrated, it shall be understood by those skilled in the art that various changes, modifications, alternatives and variants without departing from the principle and idea of the present disclosure are acceptable. The scope of the present disclosure is defined by the claims and its equivalents.

What is claimed is:

1. A ceiling-embedded air conditioner comprising:

a housing comprising a top plate and an enclosing plate, the enclosing plate being connected to the top plate and surrounding a periphery of the top plate;

a heat exchanger arranged inside the housing and defining an air outlet channel with the enclosing plate;

a drain pan arranged below the heat exchanger;

a mounting shell arranged outside the enclosing plate and connected to the enclosing plate, the mounting shell comprising a through-hole extending through a top surface of the mounting shell in an up-down direction, at least a portion of an outlet pipe of the mounting shell extending through the through-hole in the up-down direction, the outlet pipe extending from the top surface of the mounting shell and out of the air conditioner in the up-down direction; and a water pump arranged on the mounting shell outside the heat exchanger and spaced apart from the heat exchanger, the water pump having a water inlet and a water outlet, and the water inlet being in communication with the drain pan, the outlet pipe being in communication with the water outlet.

2. The ceiling-embedded air conditioner according to claim 1, wherein the outlet pipe and the mounting shell are integrally formed of a single piece of material.

3. The ceiling-embedded air conditioner according to claim 1, wherein the mounting shell comprises:

a first plate body with one end connected to the enclosing plate; and a second plate body, arranged at an angle with the first plate body, with one end connected to the other end of the first plate body, the other end of the second plate body being connected to the enclosing plate, a mounting space for mounting the water pump being defined between the enclosing plate, the second plate body and the first plate body.

4. The ceiling-embedded air conditioner according to claim 1, wherein the enclosing plate is provided with an opening portion, and a part of the water pump extends through the opening portion into the air outlet channel.

5. The ceiling-embedded air conditioner according to claim 4, wherein a cross section of the enclosing plate is polygonal and the opening portion is formed at a corner of the enclosing plate.

6. The ceiling-embedded air conditioner according to claim 1, wherein one of the mounting shell and the enclosing plate is provided with a hook, and the other one of the mounting shell and the enclosing plate is provided with a hanging hole matching the hook.

7. The ceiling-embedded air conditioner according to claim 1, wherein the mounting shell is provided with a first screw hole, and the enclosing plate is provided with a second screw hole corresponding to the first screw hole.

8. The ceiling-embedded air conditioner according to claim 1, further comprising a first heat insulating member arranged on an inner wall of the mounting shell.

9. The ceiling-embedded air conditioner according to claim 1, further comprising a second heat insulating member that comprises:

a body portion arranged on an inner wall of the top plate; and an extension portion with one end connected to the body portion and the other end extending downwardly, at least a part of the extension portion being located between the water pump and the heat exchanger.

10. The ceiling-embedded air conditioner according to claim 9, wherein a width of the extension portion is greater than or equal to a width of the water pump.

11. The ceiling-embedded air conditioner according to claim 9, wherein the other end of the extension portion extends downwardly from the body portion between the water pump and the heat exchanger to be flush with or beyond a lower end face of the heat exchanger.

12. The ceiling-embedded air conditioner according to claim 9, wherein the second heat insulating member is an integrally formed member.

13. The ceiling-embedded air conditioner according to claim 1, further comprising a guide member with one end connected to the top plate and the other end extending downwardly, at least a part of the guide member being located between the water pump and the heat exchanger.

14. The ceiling-embedded air conditioner according to claim 1, wherein the drain pan comprises:

a first water receiving portion located below the heat exchanger; and a second water receiving portion in communication with the first water receiving portion, the second water receiving portion being located below the water pump, and the water inlet extending into the second water receiving portion.

15. The ceiling-embedded air conditioner according to claim 1, wherein the up-down direction comprises a direction from the drain pan toward the top plate.

16. The ceiling-embedded air conditioner according to claim 1, wherein a sidewall of the through-hole forms the portion of the outlet pipe.

17. A ceiling-embedded air conditioner comprising:

a housing comprising a top plate and an enclosing plate, the enclosing plate being connected to the top plate and surrounding a periphery of the top plate;

a heat exchanger arranged inside the housing and defining an air outlet channel with the enclosing plate;

a drain pan arranged below the heat exchanger;

a water pump arranged outside the heat exchanger and spaced apart from the heat exchanger, the water pump having a water inlet and a water outlet, and the water inlet being in communication with the drain pan; and a mounting shell arranged outside the enclosing plate and connected to the enclosing plate, the water pump being arranged on the mounting shell, the water outlet extending from the water pump in a first direction toward the mounting shell, a through-hole extending through a surface of the mounting shell in a second direction, at least a portion of an outlet pipe of the mounting shell extending through the through-hole in the second direction, the outlet pipe being disposed in fluid communication with the water outlet, the second direction being perpendicular to the first direction.

18. The ceiling-embedded air conditioner according to claim 17, wherein a sidewall of the through-hole forms the portion of the outlet pipe.

19. A ceiling-embedded air conditioner comprising:

a housing comprising a top plate and an enclosing plate, the enclosing plate being connected to the top plate and surrounding a periphery of the top plate;

a heat exchanger arranged inside the housing and defining an air outlet channel with the enclosing plate;

a drain pan arranged below the heat exchanger;

a water pump arranged outside the heat exchanger and spaced apart from the heat exchanger, the water pump being mounted to a mounting shell, the mounting shell being separate from the housing and arranged outside the enclosing plate, the water pump having a water inlet and a water outlet, and the water inlet being in communication with the drain pan; and a heat insulating member spaced apart from the water pump and the mounting shell, the heat insulating member comprising:

a body portion arranged on an inner wall of the top plate; and an extension portion with one end connected to the body portion and the other end extending downwardly, at least a part of the extension portion being located between the water pump and the heat exchanger and spaced apart from the water pump and the heat exchanger.

* * * * *